United States Patent [19]

Kendrick

[11] Patent Number: 4,567,611

[45] Date of Patent: Feb. 4, 1986

[54] VEST FOR A NURSING MOTHER

[76] Inventor: Stephen Kendrick, 1250 N. State College, #30, Anaheim, Calif. 92806

[21] Appl. No.: 724,899

[22] Filed: Apr. 19, 1985

[51] Int. Cl.[4] ..... A41D 1/20; A41D 1/04

[52] U.S. Cl. ..... 2/104; 2/102

[58] Field of Search ..... 2/104, 102, 106, 69

[56] References Cited

U.S. PATENT DOCUMENTS

| | | | |
|---|---|---|---|
| 697,576 | 4/1902 | Walter et al. . | |
| 890,614 | 6/1908 | Culver . | |
| 1,013,778 | 1/1912 | Jacoby . | |
| 1,206,480 | 11/1916 | Stagg . | |
| 1,290,142 | 1/1919 | Elowsky . | |
| 1,664,214 | 3/1928 | Hudson . | |
| 2,417,888 | 3/1947 | Schuster | 2/104 |
| 2,911,650 | 11/1959 | Gerich | 2/74 |
| 3,423,761 | 1/1969 | Nickerson | 2/74 |
| 3,611,439 | 10/1971 | Meyers | 2/74 |
| 4,004,294 | 1/1977 | Pinch | 2/104 |
| 4,031,566 | 6/1977 | Johnson | 2/104 |
| 4,106,122 | 8/1978 | Dodd | 2/104 |
| 4,144,593 | 3/1979 | Timmons | 2/104 |
| 4,208,743 | 6/1980 | Whitecraft | 2/104 |
| 4,280,228 | 7/1981 | Sulzmann | 2/104 |
| 4,446,572 | 5/1984 | Lindquist | 2/104 |
| 4,458,365 | 7/1984 | Wood | 2/104 |
| 4,468,816 | 9/1984 | Kaufer | 2/104 |

FOREIGN PATENT DOCUMENTS

| | | | |
|---|---|---|---|
| 829656 | 7/1938 | France | 2/104 |

*Primary Examiner*—Doris L. Troutman

*Attorney, Agent, or Firm*—Knobbe, Martens, Olson & Bear

[57] ABSTRACT

A garment for a nursing mother which allows an infant to be nursed in public without exposing the mother. The garment has at least one front piece that is folded over to form a flap which is removably fastened to one side of the garment to remain in the folded position during normal wear. For nursing, the flap is unfastened, unfolded and then refastened on the opposite side of the garment, the unfolded front piece forming a loose fitting drape about the front torso of the wearer which permits access for nursing by an infant, yet completely conceals the wearer.

15 Claims, 5 Drawing Figures

Fig. 1
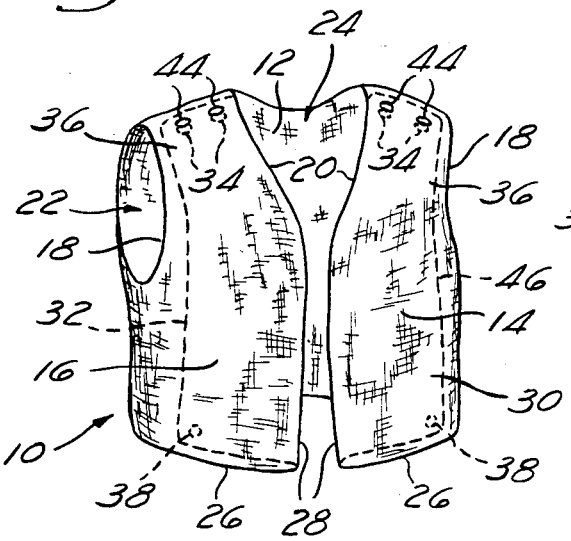
Fig. 2
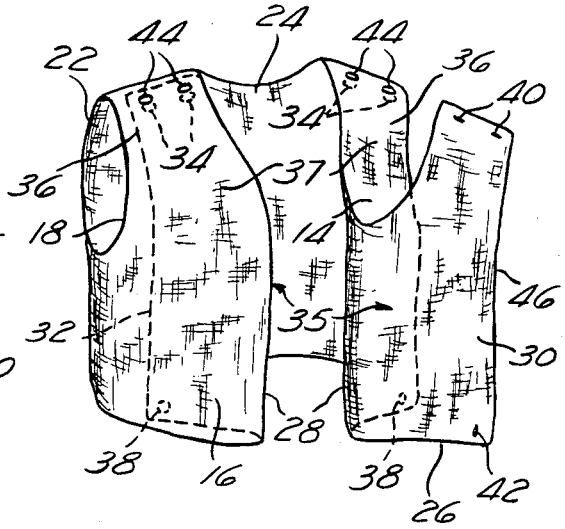
Fig. 3
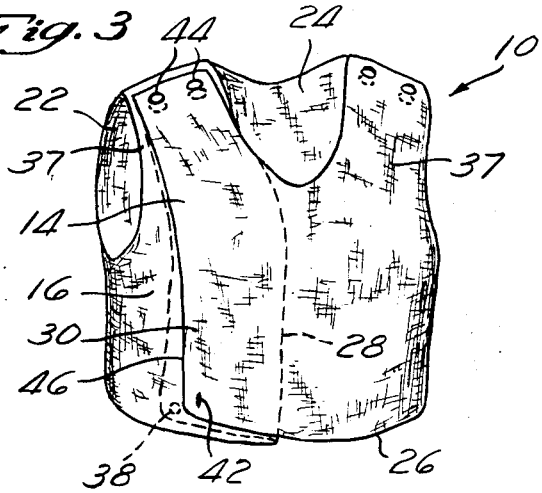
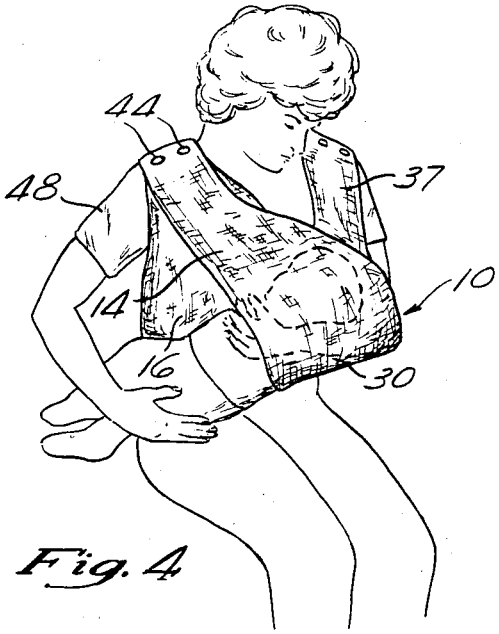
Fig. 4
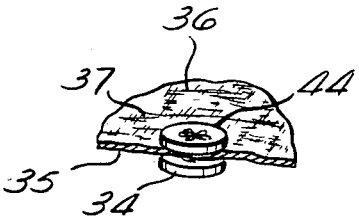
Fig. 5

VEST FOR A NURSING MOTHER

BACKGROUND OF THE INVENTION

The invention relates generally to an article of clothing, and more particularly to a garment which is to be worn by a nursing mother.

Many nursing mothers desire to have the option to conveniently nurse their children in public without having to become partially disrobed and exposed while doing so.

Previous garments for nursing mothers have suffered from several disadvantages. First, although the garments provide openings to allow access to the wearer's breasts, the wearer is not fully covered during nursing, and risks exposure of her breasts. Typically a flap of fabric is used to lay over the slit or opening in the garment during nursing, however, these flaps are often insufficient to provide complete privacy for the mother.

Secondly, none of the previous garments can be fashionably styled and worn over a conventional article of clothing, without compromising the functional attributes of the nursing garment.

Thus, a need exists for a garment which itself can be fashionably styled, can be worn over a conventional article of clothing, and which conveniently and discreetly provides access to the wearer's breasts while completely concealing the wearer during nursing.

SUMMARY OF THE INVENTION

Briefly stated, the invention relates to a garment for a nursing mother which has at least one front piece that is folded over at a central edge to form a flap. The flap is normally removably fastened to the same side of the garment to which it is attached so as to remain in a folded position during normal wear. For nursing, the flap is unfastened, unfolded and draped across the front torso of the wearer and then refastened to the opposite side of the garment so that the flap remains unfolded and in a position to cover the entire front torso of the wearer. The unfolded flap is large enough so that the garment completely surrounds and conceals the mother and infant's head during nursing, and is sufficiently loose fitting to provide room to slide the infant underneath the garment.

The garment can be worn over a conventional blouse or dress, which itself can be unfastened underneath the nursing garment, without exposure after the nursing garment is arranged with the flap in the unfolded nursing position.

The garment can be fashioned into various styles of jackets, vests, blouses, and dresses while still incorporating the novel folded over front piece feature. In a preferred embodiment, the garment is formed into a vest having a back piece, a left front piece and a right front piece, which together form a vest with two arm holes and a neck hole. The vest is to be worn over a conventional garment.

Advantageously, both the left front piece and the right front piece of the vest are folded at their central edges to form flaps, which are substantially the same size and shape as their respective front pieces. The flaps are folded to the interior of the vest, and are fastened to the garment interior by buttons on the interior of the front pieces, which mate with button holes on the flaps. Concealed access to either breast for feeding is accomplished by unfastening the flap on that side of the vest and refastening it to exterior buttons on the front piece of the opposite side of the garment.

In another preferred embodiment, the flaps are normally folded over and fastened to the exterior of the vest, and the central edges formed by the folds are removably fastened together, so as to form a garment which can be worn without an additional garment underneath it. The central edges can be unfastened, without exposing the wearer, after one of the flaps is in position for nursing, that is, unfolded and fastened to the exterior of the opposite side front piece.

BRIEF DESCRIPTION OF THE DRAWINGS

FIG. 1 is a perspective view of a nursing mother's vest with its flaps folded and fastened in position for normal wear.

FIG. 2 is a perspective view of the vest in FIG. 1, with one flap unfastened and partially unfolded.

FIG. 3 is a perspective view of the vest in FIG. 2 with one flap unfolded and fastened in position for nursing.

FIG. 4 is a perspective view of the vest in the nursing position of FIG. 3, as worn by a mother during nursing.

FIG. 5 is a cross-sectional view of the shoulder buttons and shoulder portion of the vest.

DETAILED DESCRIPTION OF THE PREFERRED EMBODIMENT

FIGS. 1–4 show the inventive garment in a preferred embodiment as a vest 10.

Referring to FIG. 1, the vest 10 is formed from a back piece 12, a left front piece 14 and a right front piece 16. Arm hole edges 18 and a neck hole edge 20 on each piece define two arm holes 22 and a neck hole 24, respectively. The front pieces 14 and 16 and back piece 12 terminate at a waist edge 26, which is preferably coincident with the wearer's waist, although the length of the garment may vary.

Each front piece also has a central edge 28 which is formed by folding a portion of the front piece back over on itself. The folded over portion of the left front piece 14 forms a left flap 30, and the folded right front piece 16 forms a right flap 32. As shown in dotted lines in FIG. 1, both flaps are preferably folded to the interior of the vest.

The central edges 28 of the front pieces 14 and 16 are split, or unfastened, in the embodiment illustrated in the drawings, however, fasteners such as buttons may be added to the central edges 28 so that the front pieces of the vest may be removably joined together.

FIG. 1 shows the vest 10 as worn normally, with both flaps 30 and 32 in a folded position. As folded, each front piece 14 and 16 is large enough to cover the breast directly beneath it. To retain the flaps 30 and 32 in this folded position, each flap is removably fastened to an interior surface 35 of its respective front piece. Fastening is achieved by a set of interior shoulder buttons 34 (shown in dotted lines) on the interior surface 35 of the shoulder portion 36 of the front piece, and an interior waist button 38 adjacent the waist edge 26 of the front piece. The interior shoulder buttons 34 are matched with a set of buttonholes 40 on the flap, and mating button hole 42 for the waist edge button 38 are located on the flap adjacent the waist edge 26 (See FIG. 2).

FIG. 3 shows the vest 10 with the left flap 30 in the nursing position, for nursing from the left breast of the wearer. The shoulder button holes 40 of the flap 30 are now fastened to a set of exterior shoulder buttons 44 on an exterior surface 37 of the right front piece 16. The front piece 14 is large enough so that the side edge 46 of the left flap 30 extends to the side of the right front piece central edge 28 (shown in dotted lines) to simultaneously cover both breasts of the wearer. The side edge 46 sufficiently overlaps the right front piece 16 so that when the flap 30 is lifted to provide access for the nursing infant, the wearer still remains completely covered, and does not have to risk baring herself.

Although not shown, nursing is permitted from the right breast in a similar manner to that illustrated with respect to the left breast. The left front piece 14 has exterior shoulder buttons 44 to which the right flap 32 can be fastened when unfolded, allowing concealed access to the right breast.

As shown in FIG. 5, the interior and exterior shoulder buttons, 34 and 44, are directly adjacent each other on the interior surface 35 and exterior surface 37 of the shoulder portion 36.

The location of the buttons 34, 44, and 38 may be varied, depending on the size and shape of the flaps. While buttons are the preferred fasteners, any other suitable fastening means can be substituted, such as Velcro® strips, hooks and eyes, snaps, or zippers.

During use, the vest 10 normally is worn with the flaps 30 and 32 secured in the folded position, and fastened by the interior shoulder buttons 34 and the interior waist edge button 38, as shown in FIG. 1. Referring to FIG. 4, the vest is worn over a piece of conventional clothing 48, such as a blouse or dress. Advantageously, a single vest 10 can be used to permit convenient and discreet nursing with virtually the entire conventional wardrobe of the nursing mother.

To ready the wearer's garments for nursing, the flap of the front piece covering the breast to be suckled is first unfastened from the interior shoulder buttons 34 and interior waist button 38, and unfolded, as in FIG. 2.

The loose flap is then unfolded and drawn across the front torso of the wearer and fastened to the exterior shoulder button 44 of the opposite front piece, as in FIG. 3, to form a loose-fitting drape across the front torso of the wearer.

The wearer can then discreetly loosen or unfasten whatever conventional garments 48 are beneath the vest by reaching underneath the side edge 46 of the unfolded flap. Once the mother has readied her conventional garments 48 for nursing, the infant's head and upper body is placed underneath the flap 30, as illustrated in FIG. 4.

The mother's breast is completely concealed from exposure as she prepares her garments, and even while the infant is nursing beneath the vest. On the side of the vest covering the nursing breast, the front piece 30 forms a continuous piece of fabric with the back piece 12. On the other side of the vest, the side edge 46 of the flap 30 overlaps the central edge 28 of the folded front piece 32 and extends over the breast that is not being nursed from, so that the flap 30 completely conceals the mother and nursing infant's head during nursing.

Preferably, the flaps are the same size and shape as the front pieces so that the flaps, when folded, do not visibly protrude beyond the edges of the front pieces. The flaps are thus as large as possible to provide maximum privacy during nursing yet remain completely hidden during normal wear with only a single fold.

After the infant has finished feeding, the above steps are reversed; the mother arranges her clothing 48 beneath the vest 10, unfastens the flap 30 from the exterior shoulder buttons of the opposite side, folds the flap 30 underneath its front piece and then fastens the folded flap to the interior buttons of its front piece 14.

In another preferred embodiment, not shown, the flaps 30 and 32 are folded over the exterior 37 of the front pieces 14 and 16 during normal wear, and are fastened to the front pieces by exterior buttons 44 only. The construction and operation of the garment is similar to the illustrated embodiment except that there is no need for a set of interior fasteners 34 on each front piece in addition to the exterior fasteners 44. Also, there must be a fastener on both surfaces of the flap since in each fastened position, folded and unfolded, a different surface of the flap faces the fasteners on the front pieces. However, buttonholes 40 through the flap, as in the illustrated embodiment, serve as fasteners on both surfaces of the flap.

An advantage of this embodiment is that the central edges 28 of the front pieces 14 and 16 can be removably fastened together during normal wear, and unfastened after one of the flaps is in the nursing position, so as to eliminate the need for a conventional garment 48 to be worn underneath the vest.

In operation, a folded flap is unfastened from the exterior buttons of its front piece, unfolded and refastened to the opposite side front piece. At this point, the central edges of the garment are unfastened, beneath the protection of the unfolded flap, to provide access to the mother's breast. After nursing, the steps are reversed.

The nursing garment of either embodiment can easily be varied to result in stylish designs which do not compromise the garment's inventive functional attributes. Virtually all fabrics can be utilized to construct the garment. In particular, the same fabric can be used to construct the vest as is used to construct the conventional garment worn underneath, so as to disguise the function of the nursing garment. Also, long or short sleeves can be attached to the arm holes, and collars can be joined to the neck hole edge to create jackets or blouses. Skirts or pants can be attached to the waist edge of the garment to form a dress or a pant suit. The illustrated embodiment is also easily reversible, since the shoulder buttons are already on both the interior and exterior sides of the garment. Additionally, ornamental trim or lining can be incorporated into the garment.

What is claimed is:

1. A fashionably styled vest-like garment which (i) is worn over a conventional article of clothing, (ii) conveniently and discreetly permits a nursing mother to nurse her infant, (iii) conceals the mother's breasts and nursing infant's head while nursing, and (iv) is styled to match the remaining dress of the mother so as to disguise the function of the garment during normal wear, such garment comprising:

a first front piece large enough to cover both breast of the wearer and the head of the nursing infant, said front piece being folded over at one edge to form a flap;

a first fastening means on said first front piece and said flap for removably fastening the flap to the first front piece in a folded position during normal wear covering only one of the breasts;

a second front piece for covering the other of said breasts during normal wear; and a second fastening means on said second front piece for removably fastening said flap to said second front piece, said second fastening means being positioned so that when the flap is detached from said first fastening means and attached to the garment by said second fastening means, the first front piece becomes unfolded and forms a loose fitting drape across the front torso of the wearer and the nursing infant's head, underneath which the wearer can nurse the infant without being exposed.

2. The garment of claim 1 wherein the edge formed by the fold of the first front piece is fastened to the second front piece by a third fastening means.

3. A fashionably styled garment for a nursing mother which conveniently and discreetly permits a nursing mother to nurse her infant, and conceals the mother's breasts and nursing infant's head while nursing, comprising a left front piece and a right front piece for respectively covering the left and right front sides of the wearer's torso during normal wear, each front piece being folded over at one edge to form flaps, the flap formed by the left front piece normally being folded and fastened to the left front piece by a first fastening means, and the flap formed by the right front piece normally being folded and fastened to the right front piece by a second fastening means, the first and second fastening means being interchangeable so that to provide concealed access to a breast for nursing an infant, the flap on the corresponding front piece can be unfastened from its normal fastening means, unfolded, and refastened to the other front piece by the other fastening means to form a loose fitting drape across the front torso of the wearer underneath which the wearer can nurse without being exposed.

4. The garment of claim 3 wherein the fold of each of the front pieces forms a central edge, and the central edges of the two front pieces are removably fastened together by a third fastening means.

5. The garment of claim 3 wherein said first and second fastening means each comprise:

a first type of fastener on both the interior and exterior surface of both front pieces, a second type of fastener on both flaps which mates with said first type of fastener, wherein said second type of fastener fastens the flaps to the interior of the front pieces by mating with the first type fasteners on the interior of the front pieces when the flaps are inwardly folded during normal wear, and wherein said second type of fastener also fastens the flaps to the exterior of the front pieces by mating with the first type of fastener on the exterior of the front piece when a flap is unfolded to form a drape across the wearer's front torso for nursing.

6. A fashionably styled garment which (i) is worn over a conventional article of clothing, (ii) conveniently and discreetly permits a nursing mother to nurse her infant, (iii) conceals the mother's breasts and nursing infant's head while nursing, and (iv) is styled to match the remaining dress of the mother so as to disguise the function of the garment during normal wear, such garment comprising:

a back piece having two arm hole edges, a neck hole edge, and a waist edge;

a left front piece and right front piece, each of said front pieces having a neck hole edge and arm hole edge, a waist edge and a central edge, the front pieces being joined to the back piece to form a garment with two arm holes, and a neck hole;

a flap on each front piece formed by a fold in the front piece at the central edge; and mating fasteners on each front piece and flap for removably fastening the flap to its respective front piece during normal wear, and positioned so that during the nursing of an infant, the flap of the front piece corresponding to the breast to be nursed from can be unfastened from that front piece, unfolded, and fastened by the mating fasteners to the other front piece, to form a drape around the front torso of the wearer which allows the infant access to the desired breast, and also completely conceals the mother.

7. The garment of claim 6 wherein said mating fasteners comprise:

one or more button holes on the flaps;

one or more interior buttons on the interior of the front pieces, said interior buttons mating with said button holes on the flaps, said flaps being buttoned to the interior buttons of their respective front pieces during normal wear to remain in a folded position, and one or more exterior buttons on the exterior of the front pieces, said exterior buttons mating with the button holes on the flaps, the flap of one front piece being buttoned to the exterior buttons of the other front piece when that flap is unfolded and in position for nursing.

8. The garment of claim 7 wherein said interior and exterior buttons are located on the shoulder portion of each front piece.

9. The garment of claim 8 wherein there is a second set of mating fasteners on each front piece and flap adjacent the waist edge, for fastening the flaps to their front pieces, to retain the flaps in a folded position during normal wear.

10. The garment of claim 6 wherein each flap is substantially the same size and shape as the remainder of the front piece.

11. The garment of claim 6 wherein there are sleeves attached to said arm holes.

12. The garment of claim 6 wherein there is a collar attached to said neck hole.

13. The garment of claim 6 wherein there is a skirt or pair of pants attached to said waist edge.

14. A garment for a nursing mother comprising:

a first front piece for covering one side of the wearer's front torso, said first front piece being folded over at one edge to form a flap;

a second front piece for covering the other side of the wearer's front torso;

a first fastening means on said first front piece for removably fastening said flap to said first front piece in a folded position during normal wear; and a second fastening means on said second front piece for removably fastening said flap to the second front piece in an unfolded position, said second fastening means being positioned so that when the flap is detached from said first fastening means and attached to the second fastening means the first front piece becomes unfolded and forms a loose fitting drape across the front torso of the wearer.

15. The garment of claim 14 wherein the edge formed by the fold of the first front piece is fastened to the second front piece by a third fastening means.

* * * * *